US005916283A

United States Patent [19]

Steinbach

[11] Patent Number: 5,916,283

[45] Date of Patent: Jun. 29, 1999

[54] KEY RING LOCK ASSEMBLY

[75] Inventor: Robert Steinbach, Kenosha, Wis.

[73] Assignee: Chicago Lock Company, Pleasant Prairie, Wis.

[21] Appl. No.: 09/024,387

[22] Filed: Feb. 17, 1998

[51] Int. Cl.[6] ..... A44B 15/00

[52] U.S. Cl. ..... 70/456 R; 70/38 A; 70/39; 70/49; 70/50; 70/459

[58] Field of Search ..... 70/18, 49, 58, 70/38 A, 39, 53, 50, 456 R, 457, 459, 460; 206/37.1, 37.8; 24/3.6; 40/634

[56] References Cited

U.S. PATENT DOCUMENTS

| | | | |
|---|---|---|---|
| 1,689,437 | 10/1928 | Hurd | 70/49 |
| 2,631,449 | 3/1953 | Protsman | 70/457 |
| 3,572,063 | 3/1971 | Foote | 70/50 |
| 3,728,879 | 4/1973 | Best | 70/49 X |
| 3,765,197 | 10/1973 | Foote | 70/490 X |
| 3,841,118 | 10/1974 | Stone | 70/49 X |
| 3,855,824 | 12/1974 | Falk | 70/49 X |
| 4,667,491 | 5/1987 | Lokkeu et al. | 70/18 X |
| 4,676,084 | 6/1987 | Signorelli | 70/50 X |
| 4,693,098 | 9/1987 | Davis | 70/18 X |
| 4,920,772 | 5/1990 | Denison | 70/53 |
| 5,400,625 | 3/1995 | Embry | 70/38 A |

FOREIGN PATENT DOCUMENTS

| | | | |
|---|---|---|---|
| 812771 | 9/1951 | Germany | 70/49 |

*Primary Examiner*—Lloyd A. Gall

*Attorney, Agent, or Firm*—Basil E. Demeur; Alan B. Samlan; Robert L. Knechtel

[57] ABSTRACT

An improved key ring lock assembly including a lock mechanism having an open position and a locked position which is formed by at least a lock barrel, a lock cylinder fitted within the lock barrel, the lock cylinder having a front key way and a lock mechanism contained within the lock cylinder operable by an appropriate key. The lock cylinder terminates in a lock shaft at the back end which is rotatable in response to the manipulation of the lock mechanism via the key. A lock collar is contained within the lock barrel immediately rearward of the lock cylinder and includes a lock shaft receiving aperture to receive the lock shaft and be operable in response to the rotatable movement of the lock mechanism. The lock collar includes an elongate stud mounted on the back end which includes a pair of opposed pin receiving channels formed therein. The lock barrel includes a locking ledge circumferentially positioned along the inner wall and adjacent the back end thereof. The locking ledge is interrupted by a pair of opposed slots positioned approximately 180 degrees from one another and when in the open position, are positioned in registry with the pin receiving channels formed in the lock stud. A key cable with opposed ends is provided which includes a pair of lock pins secured to the ends thereof, each lock pin having a lock groove being sized to allow the locking ledge to ride within the confines thereof.

11 Claims, 2 Drawing Sheets

80
31
10
29
40
36
25
42
30
90
85
35
37
22
44
24
15
19
18
13
12
59
16
21
14
55
50
53
61
52
57
54

KEY RING LOCK ASSEMBLY

BACKGROUND OF THE INVENTION

The present invention relates to an improved key ring lock assembly which is intended to accommodate a plurality of keys on a ring, and permitting the ring to be locked into a lock mechanism to which access may only be gained by an appropriate key to operate the lock mechanism. Key rings of various types, sizes and descriptions are well-known in the art. The present invention particularly relates to a key ring lock assembly intended for carrying a multitude of keys such as the type which would be employed by route manager that has responsibility for gaining entry into a great number of keyed lock boxes, such as vending machines, and is required to have the entire key ring secured for purposes of his job function. An examples of this type of situation would be a route man intended to empty a variety of vending machines on a vending route and is required to carry a plurality of keys on a single ring in order to complete a job function.

In most instances, key rings presently available tend to be fixed rings formed of a circular steel ring upon which the keys are carried, with the ring having some type of security mechanism for locking the ring onto a belt, or other structure. A more recent attempt at providing a locking key ring is demonstrated in U.S. Pat. 5,400,625. The structure depicted therein provides a lock mechanism in which a shackle type ring is provided, upon which the keys are retained, and the shackle then being permitted to lockingly engage in a lock mechanism is provided.

However, the device as depicted in U.S. Pat. No. 5,400,625 represents a typical type cam lock in which a locking cam manipulates or turns in order to lockingly engage in a reduced diametric end portion of the lock shackle in order to lock the ring position in the lock mechanism. As demonstrated therein, a tail shaft is provided in the nature of a lock shaft, which engages the lock cam, in order to rotate the locking cam once the shackle is positioned in the lock. The locking cam is provided with a pair of opposed notches which will rotate once the tail shaft is rotated and result in the shackle being locked into position.

Other prior art attempts have been made at providing cable type locks, such as exemplified in U.S. Pat. No. 3,728,879 among others. In this instance, the cable lock is in the form of a shackle padlock, and operates in the same fashion as a pad lock with a sliding reciprocating tumbler or bolt which engages a retaining groove at the tail end of the shackle.

Another version of a cable lock is illustrated in U.S. Pat. No. 3,841,118, which illustrates a cable lock which is locked between a pair of opposed mating block sections which lock over the cable once the cable is inserted into the block.

Other prior art patents illustrate a variety of formats for cable locks generally intended as bicycle locks, motorcycle locks and the like. These are exemplified by U.S. Pat. No. 4,920,772, as well as U.S. Pat. No. 4,667,491; U.S. Pat. No. 4,693,098; and tire chain locks as illustrated by U.S. Pat. No. 1,689,437.

The present invention is intended to improve upon a cable type lock mechanism intended to accommodate a plurality of keys, and further providing enhanced security for the users of such types of locks.

OBJECTS AND ADVANTAGES

It is therefore the principal object of the present invention to provide an improved key ring lock assembly which employs a typical lock barrel and lock cylinder contained therein, the lock cylinder being operated by an appropriate key. The improvement resides in an improved lock collar which mates with and is operated by the lock cylinder, coupled with and cooperating with a lock barrel provided with a locking edge adjacent the back end thereof. The lock collar is provided with an elongate lock stud which is formed with a pair of pin receiving channels in opposed relation thereto, while the locking edge is provided with a pair of opposed slots formed therein, which will be in registry with the pin receiving channels of the lock collar when the lock is in the open position, and designed to be out of registry with the pin receiving channels when the lock is in the lock position. The cable key ring has opposed ends which carry a pair of lock pins secured thereto, each of the lock pins carrying lock grooves formed adjacent the ends thereof, the lock grooves being sized and designed to accommodate the locking ledge to ride within the confines thereof during the locking and unlocking procedure.

In accordance with the object as set forth above, a further object of the present invention is to provide a key ring lock assembly of the type described which reduces the number of movable parts within the lock mechanism, but further provides increased security for the key ring when locked into the lock mechanism.

In accordance wit the foregoing objects, a further object of the present invention is to provide a key ring lock assembly of the type described, wherein the barrel further is provided with an extension shroud at the front end thereof, the extension shroud overlying the lock cylinder such that when fully assembled, the lock cylinder is recessed relative to the front end of the lock barrel. The extension shroud includes a pair of opposed slots which accommodates the insertion of a security strap therethrough, the security strap, when inserted, overlying the key way of the lock cylinder thereby to prevent access thereto with the key unless the security strap is removed. The provision of a security strap immediately demonstrates to the operator or user of the key ring that security has been breached if the strap has been removed prior to his possession of the ring.

The above objects and further objects and advantages of the present invention will best be understood by reference to the following specification taken in conjunction with the accompanying drawings.

SUMMARY OF THE INVENTION

In summary, the present invention provides an improved key ring lock assembly which requires the minimum adaptation of parts in order to provide such an improved lock mechanism. The improved key ring lock assembly includes a lock barrel, a lock cylinder fitted with the lock barrel in a manner well-known in the art. The lock cylinder may be operable by either a tubular key, a single bitted key, or a double bitted key. The lock cylinder includes a typical lock mechanism operable by the appropriate key, and has a key way at the front end thereof, and terminates in a lock shaft at the back end thereof. An improved novel lock collar is provided which mates with the lock cylinder, the lock collar provided with a lock shaft receiving aperture at its front end, and an elongate lock stud extending rearwardly from the collar at the rear end thereof. The elongate stud is provided with a pair of opposed pin receiving channels formed therein and spaced at a 180 degrees apart from one another. The lock collar is rotatable in response to the rotational movement of the lock shaft when the same is seated within the lock shaft receiving aperture of the lock collar.

The lock barrel is provided with a locking ledge positioned adjacent the back end thereof, the locking ledge provided with a pair of opposed slots positioned approximately 180 degrees from each other. The elongate stud of the lock collar is generally circular in configuration, and is sized to be receivable within the interior diametric dimension of the locking ledge.

The invention further contemplates the provision of a cable ring, which is generally flexible, the cable key ring including a pair of lock pins secured to the ends thereof. Each lock pin is provided with a lock groove positioned at and adjacent to the ends of each of said lock pins, the lock grooves having a dimension sized in order to accommodate the riding of the locking ledge therein.

In use, the lock is manipulated to the open position at which time, the elongate stud, and specifically a pair of opposed pin receiving channels formed therein are in registry with the opposed slots in the locking ledge, in order to allow the lock pins of the cable ring to be inserted therethrough. The lock pins will be inserted until they reach a stop position provided in the lock collar, at which point, the lock grooves in the lock pins of the cable are in registry with the locking ledge formed in the lock barrel. The appropriate key may then be utilized to manipulate the lock cylinder and rotate the lock collar which will cause the lock pins of the cable ring to ride onto the locking ledge, and when turned a quarter turn or 90 degrees, will ride out of registry with the opposed slots in the locking ledge. In such position, the cable ring is lockingly engaged to the lock mechanism.

A further improvement provided by the present invention is the modification of the lock barrel to include an extension shroud which extends over and overlies the lock cylinder when the lock cylinder is full installed within the barrel. The extension shroud includes a pair of opposed slots positioned in 180 degree opposition to each other, and accommodates the insertion of a flexible and frangible security strap therethrough. The security strap is inserted through one of the security slots, and then through the opposed security slot, and then the two ends are secured to each other. In this position, the appropriate key cannot gain access to the lock mechanism until the security strap is removed. Once the security strap is removed, any user of the ring, when viewing the strap removed knows that access has been gained to the lock, and is alert to possible security difficulties.

DETAILED DESCRIPTION OF DRAWINGS

Figure 1:
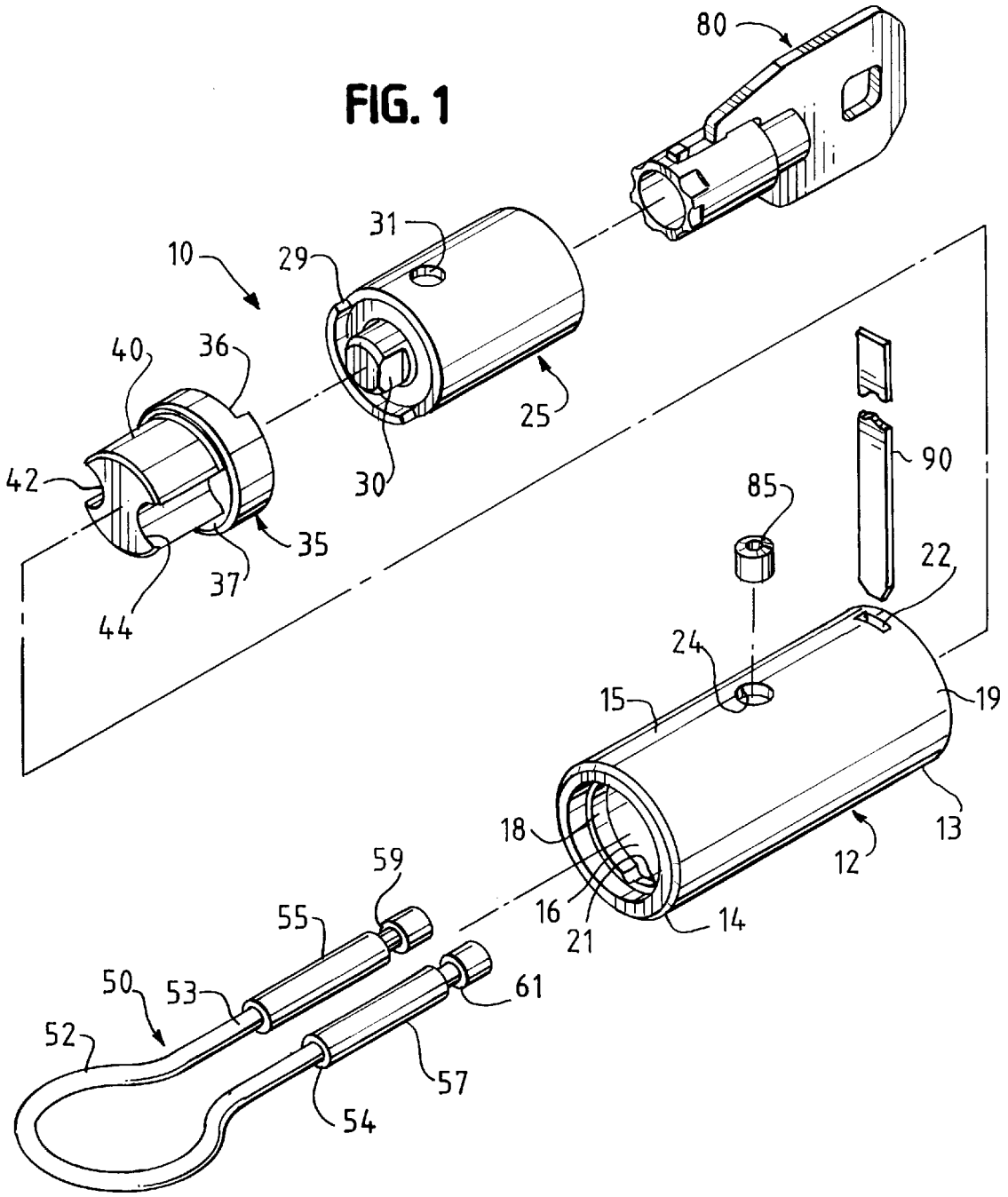
FIG. 1 is a plan exploded view showing the various parts of the lock assembly forming the key ring locking mechanism assembly of the present invention.

As generally indicated in FIG. 1, the key ring lock assembly is generally illustrated by the numeral 10, and is shown to be formed by a lock barrel 12, lock cylinder 25, lock collar 35, and a key ring cable 50. As is well-known in the art, the lock cylinder 25 is operable by an appropriate key 80, which as illustrated in the drawings, is shown to be a tubular key. However, the present invention contemplates that the lock cylinder 25 may be of the type operated by a single-bitted key as well as a double bitted key, or other types of keys known in the art.

Figure 2:
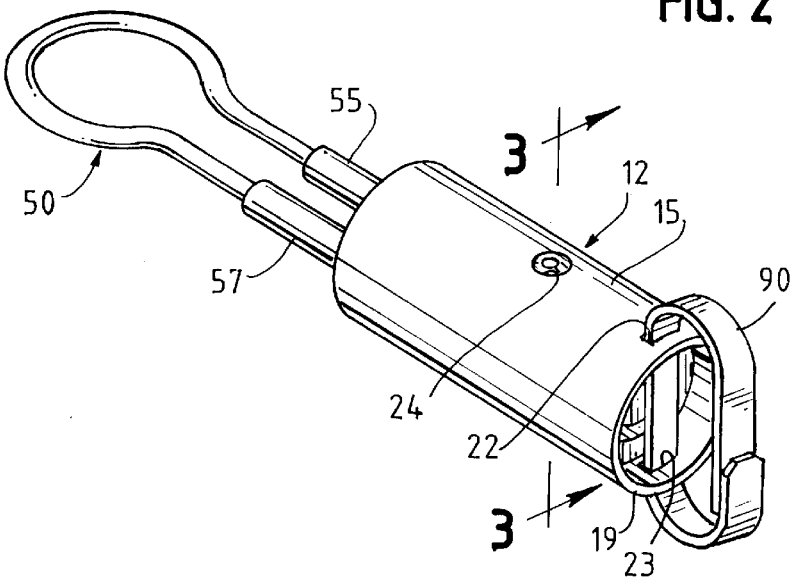
FIG. 2 is a plan view showing the lock assembly as assembled, and with the security strap in place and with the cable key ring locked into the lock mechanism.

With particular reference to the lock barrel 12, the lock barrel is shown to be cylindrical in configuration, and as is generally known in the art is elongate in configuration. The lock barrel 12 includes a forward end 13, and a back end 14, and having an outer wall 15, and an inner wall 16. The inner wall 16 is provided with a locking ledge 18 which is circumferentially positioned adjacent to the back end 14 of the barrel 12, and includes a pair of slots 20 and 21 respectively, which interrupt the locking ledge 18. The forward end 13 of the lock barrel 12 includes an extension shroud 19 (FIG. 2) which overlies the lock cylinder 25 in the assembled configuration. The extension shroud 19, includes a pair of opposed security slots 22 and 23 respectively as illustrated in FIGS. 1 and 2. Lock barrel 12 is completed by a pin aperture 24 which is provided for a purpose to be described.

The lock cylinder 25 is of typical construction, and is adapted to contain a lock mechanism 26 including a front key way 28 which is operable by key 80. The lock cylinder 25 includes a back end 29 and includes a lock shaft 30 which extends outwardly from the back end 29 thereof. The lock cylinder 25 is further provided with a pin aperture 31, and as will be observed in FIGS. 2 and 3 of the drawings, when the lock cylinder 25 is installed within the lock barrel 12, an appropriate pin 85 may be inserted through the pin aperture 24 and the lock barrel 12, and through the pin aperture 31 and the lock cylinder 25, in order to secure the two parts together. Hence, it will be appreciated that the lock cylinder 25 does not rotate relative to the lock barrel 12, but rather, the lock mechanism 26 contained within the lock cylinder 25 does rotate in response to the rotational movement of the key 80, and will rotate the lock shaft 30 in response thereto.

It is contemplated that within the confines of the present invention, the lock cylinder 25 operates in the same manner as prior art lock cylinders in that it is provided with a plurality of tumblers which are keyed to the key 80, and manipulates the lock cylinder in a manner commonly known in the art in order to rotate the lock shaft 30. Hence, the particular construction of the lock cylinder 25 is not deemed critical to the operation of the present invention.

Figure 3:
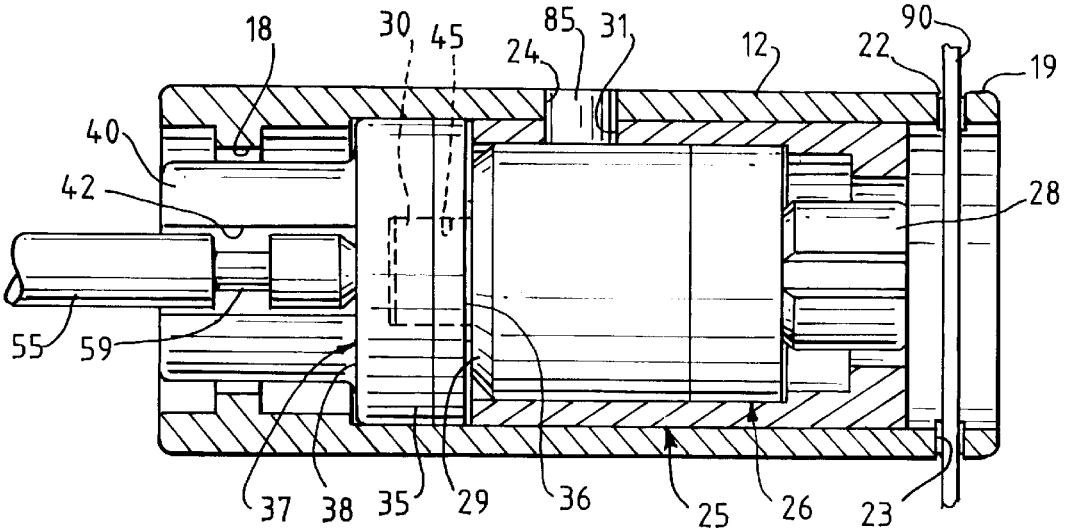
FIG. 3 is a side elevational view, in cross-section, taken along the lines 3—3 of FIG. 2.

Again as illustrated in FIGS. 1 and 3 of the drawings, the lock mechanism of the present invention is provided with a lock collar 35 as illustrated. The lock collar 35 includes a front end 36, and a back end 37. The lock collar 35 is provided with an elongate stud 40 which extends rearwardly from the back end 37 of the lock collar 35. The elongate stud 40 is shown to be shaped and provided with a pair of opposed pin receiving channels 42 and 44 respectively. Further, it will be observed that the elongate stud 40 is sized such that the same fits within the diametric confines of the locking ledge 18. This will be observed in FIG. 3 of the drawings. Furthermore, it will be observed that when the lock is in the unlocked position (FIG. 5), the pin receiving channels 42 and 44 respectively are in registry with the opposed slots 20 and 21 formed in the locking ledge 18. As shown in FIG. 3, the lock collar 35 further includes a lock shaft receiving aperture 45 formed in the front end 36 of said lock collar 35 in order to receive the lock shaft 30 therein. As will be observed in FIG. 3, once the appropriate key 80 is inserted into the lock mechanism 26 in order to rotate the lock mechanism 26, the lock shaft 30 is rotated and in turn, will rotate the lock collar 35. Since the elongate stud 40 is attached to and formed as a part of the lock collar 35, the elongate stud 40 will rotate, thereby rotating the corresponding pin receiving channels 42 and 44 respectively.

As shown in FIGS. 1 through 3 of the drawings, the improved cable key ring lock assembly 10 of the present invention is completed by the provision of a cable key ring 50. The cable key ring 50 includes a cable 52 which has opposed ends 53 and 54 respectively. Each of the ends 53 and 54 respectively are provided with lock pins 55 and 57 respectively. Each of the lock pins 55 and 57 is provided with a lock groove 59 and 61 respectively. Each of the lock grooves 59 and 61 is sized such that the same will accommodate the locking ledge 18 to ride within the confines thereof during the locking and unlocking procedure. As illustrated in FIG. 3 of the drawings, the lock pins 55 and 57 are each sized such that the same fit within the pin receiving channels 42 and 44 respectively.

It is also illustrated that the lock collar 35 is provided with a stop wall 38 which actually forms the back end 37 of the lock collar 35. When the lock pins 55 and 57 are inserted through the pin receiving channels 42 and 44 respectively, and through the slots 20 and 21, the same will butt against stop wall 38 thereby to provide a stop rest position for the lock pins 55 and 57 when full inserted into the lock mechanism 10.

Figure 5:
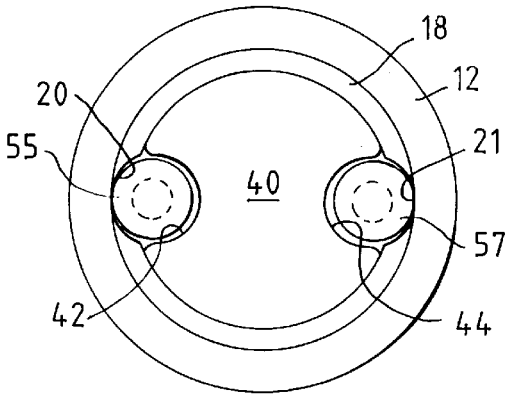
FIG. 5 is a cross-sectional view in schematic, showing the lock pins of the cable key ring in the lock mechanism in the unlocked or open position.

As illustrated in FIG. 5 of the drawings, when the lock mechanism 10 is in the unlocked position, the slots 20 and 21 and the locking ledge 18 are in registry with the pin receiving channels 42 and 44 respectively formed in the elongate stud 40. In this position, the lock pins 55 and 57 may be fully inserted into the lock mechanism 10 until the same are butted against the stop wall 38. Further, in this position, the lock ledge 18 is in registry with the lock groove 59 and 61 respectively.

Figure 4:
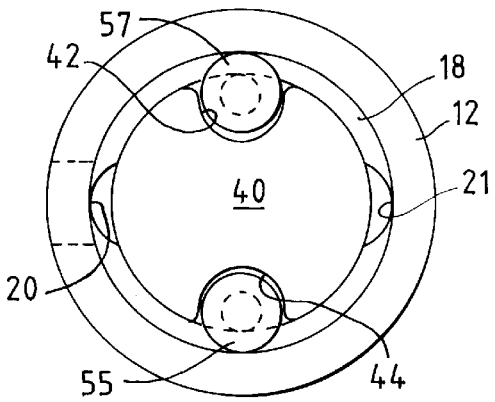
FIG. 4 is a cross-sectional view in schematic, showing the lock mechanism of the present invention with the lock pins in place and locked into position in the lock mechanism.

When the appropriate key 80 is inserted into the front key way 28, in order to reciprocate the lock mechanism 26, the locking ledge 18 will ride within the confines of the lock grooves 59 and 61 respectively until the lock positions reached as exemplified in FIG. 4. In this position, the lock grooves 59 and 61 are now secured under the locking ledge 18, and the cable key ring 50 cannot be removed from the lock mechanism 10.

FIGS. 2 and 3 of the drawings further illustrate the manner in which the security strap 90 operates. As indicated previously, the lock barrel 12 is provided with the extension shroud 19 which includes a pair of opposed slots 22 and 23. The security strap 90 is designed to fit within the slots 22 and 23, in loop fashion, with the opposed ends of the strap 90 being secured together. It is contemplated that the ends of the strap 90 are secured in the manner of self-locking plastic straps which are not possible to disengage other than by cutting the strap 90. Hence, the strap 90 should be formed of a frangible material capable of being cut or sliced by an appropriate tool.

It will be appreciated as a result of this innovation if a lock mechanism 10 of the present invention is given to an operator having a plurality of keys contained on the cable ring 50, and if the strap 90 has been tampered with and broken, one would know that someone has gained access to the lock mechanism and perhaps has removed or exchanged keys contained on the cable key ring 50. Such frangible security straps may be formed of plastic, and are otherwise presently commercially available and are of the type which generally are employed for securing a plurality of wires together and known as wire straps.

It is contemplated that the cable key ring 50 of the present invention is made of a steel cable material coated with a plastic, and sized in order to fit through the keyholes of the typical keys which are commercially available. In this manner, the present invention contemplates that the cable key ring 50 need not assume any particular shape, and is sufficiently flexible in order to accommodate any number of keys. Further, the cable may be made in any length in order to accommodate any number of keys and further, that the entire mechanism may be sold with a plurality of cables of varying lengths in order to accommodate the user's needs.

It will be appreciated from the above description that the present invention provides an improved cable key ring lock assembly which generally employs presently available lock parts, and only requires the adaptation of the lock collar and the barrel in order to produce the improved cable key ring lock assembly as described and claimed herein.

While there has been described what is at present considered to be the preferred embodiment of the invention, various obvious modifications may be made therein without departing from the true spirit and scope of the invention as described and claimed hereinafter.

I claim:

1. A key ring lock assembly having an open position and a locked position comprising in combination, a lock barrel having an outer wall and an inner wall, and a front end and a back end, said lock barrel having a locking ledge circumferentially positioned along the inner wall and adjacent the back end thereof, said locking ledge being interrupted by a pair of opposed slots positioned approximately 180 degrees from each other, a lock cylinder having a front end key way and a lock mechanism contained within said lock-cylinder operable by an appropriate key, and terminating in a lock shaft at the back end thereof, a lock collar diametrically sized to fit within and be rotatable relative to said lock barrel, said lock collar having a front end and a back end and including a lock shaft receiving aperture formed in the front end thereof, the back end of said lock collar provided with an elongate stud extending rearwardly therefrom, said stud provided with a pair of opposed pin receiving channels formed therein and extending the length thereof and terminating at a base end, said pin receiving channels being spaced 180 degrees apart and adapted to be in registry with said slots in said locking ledge when said lock collar is rotated to the open position, and out of registry when said lock collar is rotated to the locked position, said lock shaft of said lock cylinder adapted to fit within said lock shaft receiving aperture of said lock collar to operate said lock collar, a key cable having opposed ends, each of said ends provided with a lock pin secured thereto, each of said lock pins having an outer end including a lock groove formed in said pin adjacent the outer end thereof, said lock grooves being sized to allow said locking ledge to ride within the confines thereof during lock operation, whereby a plurality of keys may be carried on said key cable and said key cable may be locked into said lock barrel by inserting said lock pins into said pin receiving channels of said lock stud and through said opposed slots of said locking ledge when said lock collar is in the open position, and then said lock collar is rotated in response to the rotation of said lock shaft, said locking ledge riding within the confines of said lock grooves until said pin receiving channels and locking ledge slots are out of registry thereby to lock said key cable into said lock barrel.

2. The key ring lock assembly as set forth in claim 1 wherein said lock collar includes a stop wall positioned adjacent the base end of said stud to form a stop position for said lock pins when said lock pins are inserted into said pin receiving channels and through said slots in said locking ledge, said stop position being arranged such that said lock pin grooves are in registry with said locking ledge when said lock pins are fully inserted therethrough and resting against said stop wall.

3. The key ring lock assembly as set forth in claim 1 above, wherein said lock barrel further includes an extension shroud extending outwardly from the front end of said lock barrel such that said lock cylinder is spaced inwardly relative to said extension shroud, said extension shroud provided with a pair of opposed security slots spaced a distance apart, said opposed security slots accommodating a security strap positioned therethrough such that said security strap overlies said front end key way of said lock cylinder and prevents key access until said security strap is removed.

4. The key ring lock assembly as set forth in claim 3 above, wherein said security strap is formed of a frangible material.

5. The key ring lock assembly as set forth in claim 1 above, wherein said lock cylinder is adapted to engage and rotate said lock collar through an arc of 90 degrees in one direction to lock the collar and a reverse arc of 90 degrees in the other direction to open the collar.

6. The key ring lock assembly as set forth in claim 1 above, wherein said key cable is formed of a flexible cable wire material.

7. A key ring lock assembly including a lock mechanism adapted to have an open position and a locked position and including at least a lock barrel having an outer wall and an inner wall and a front end and a back end, a lock cylinder having a front end key way, a lock mechanism contained within said lock cylinder operable by an appropriate key and terminating in a lock shaft at the back end thereof, said lock shaft being rotatable in response to the manipulation of said lock mechanism, a lock collar contained within said lock barrel and being rotatable relative thereto, said lock collar including a front end and a back end, said front end having a lock shaft receiving aperture formed therein and adapted to receive said lock shaft therein whereby said lock collar is rotatable in response to the rotation of the lock shaft, the improvement comprising in combination, said lock barrel having a locking ledge circumferentially positioned along the inner wall thereof and adjacent the back end thereof, said locking ledge being interrupted by a pair of opposed slots positioned approximately 180 degrees from one another, said lock collar having an elongate stud mounted on the back end thereof and extending rearwardly therefrom, said stud provided with a pair of opposed pin receiving channels formed therein and extending the length thereof and terminating at a base, said pin receiving channels being spaced 180 degrees apart and adapted to be in registry with said slots in said locking ledge when said lock collar is rotated to the open position and out of registry when said lock collar is rotated to the locked position, a key cable having opposed ends, each of said ends provided with a lock pin secured thereto, each of said lock pins having an outer end including a lock groove formed in said lock pin adjacent to and spaced from the outer end thereof, said lock groove being sized to allow said locking ledge to ride within the confines thereof, whereby a plurality of keys may be carried on said key cable and said key cable may be locked into said lock barrel by inserting said lock pins into said pin receiving channels in said lock stud and through said opposed slots of said locking ledge when said lock stud is in the open position, and said lock collar may then be rotated in response to the rotation of said lock shaft, said locking ledge riding within the confines of said lock grooves until said pin receiving channels and locking ledge slots are out of registry thereby to lock said key cable into said lock barrel.

8. The key ring lock assembly as set forth in claim 7 above, wherein said lock collar includes stop means adjacent the base of said pin receiving channels thereby to form a stop position for said lock pins when inserted into said pin receiving channels and through said slots in said locking ledge, said stop position arranged such that said lock pin grooves are in registry with said locking ledge when said lock pins are fully inserted therein and resting against said stop means.

9. The key ring lock assembly as set forth in claim 7 above, wherein said lock barrel further includes an extension shroud extending outwardly from the front end thereof such that said lock cylinder is spaced inwardly relative to said extension shroud, said shroud being provided with a pair of opposed security slots formed therein, a security strap positioned through said security slots such that said security strap overlies said front end key way of said lock cylinder and prevents key access until said security strap is removed.

10. The key ring lock assembly as set forth in claim 9 above, wherein said security strap is formed of a frangible material.

11. The key ring lock assembly as set forth in claim 7 above, wherein said key cable is formed from a flexible wire cable material and said lock pins are fixedly secured to the opposed ends thereof.

* * * * *